US007891543B2

(12) United States Patent
Abel et al.

(10) Patent No.: US 7,891,543 B2
(45) Date of Patent: Feb. 22, 2011

(54) RECLOSABLE GABLE TOP CARTON

(75) Inventors: Jeffrey R. Abel, Edina, MN (US); Gary L. Sotebeer, Eden Prairie, MN (US)

(73) Assignee: Target Brands, Inc., Minneapolis, MN (US)

( * ) Notice: Subject to any disclaimer, the term of this patent is extended or adjusted under 35 U.S.C. 154(b) by 812 days.

(21) Appl. No.: 11/757,005

(22) Filed: Jun. 1, 2007

(65) Prior Publication Data

US 2008/0296360 A1 Dec. 4, 2008

(51) Int. Cl.
*B65D 5/08* (2006.01)
*B65D 5/72* (2006.01)

(52) U.S. Cl. ..... 229/137; 229/213; 229/249

(58) Field of Classification Search ..... 229/213, 229/249, 137, 913, 138, 139
See application file for complete search history.

(56) References Cited

U.S. PATENT DOCUMENTS

| | | | | |
|---|---|---|---|---|
| 2,178,730 | A | 11/1939 | Stein | |
| 2,292,653 | A | 8/1942 | Palmer | |
| 2,345,486 | A | 3/1944 | Leebov | |
| 2,695,745 | A * | 11/1954 | Dixon | 229/249 |
| 3,118,586 | A * | 1/1964 | Kelly | 229/248 |
| 3,244,353 | A | 4/1966 | Miessler, Sr. | |
| 3,924,800 | A | 12/1975 | Desmond et al. | |
| 4,042,110 | A | 8/1977 | Guernsey | |
| 4,099,665 | A * | 7/1978 | Bergstein | 229/117.34 |
| 4,228,898 | A | 10/1980 | Zeitter et al. | |
| 4,484,683 | A | 11/1984 | Werner, Jr. | |
| 4,498,585 | A | 2/1985 | Gordon et al. | |
| 4,911,563 | A | 3/1990 | Ciani | |
| 5,230,463 | A | 7/1993 | Brauner | |
| 5,505,298 | A | 4/1996 | Dlugopolski | |
| 5,816,487 | A * | 10/1998 | Skinner | 229/248 |
| 6,478,216 | B2 | 11/2002 | Wiart | |
| 6,951,530 | B2 * | 10/2005 | Toth et al. | 493/55 |
| 2003/0111521 | A1 | 6/2003 | Holmes | |
| 2005/0205604 | A1 | 9/2005 | Rochefort et al. | |

FOREIGN PATENT DOCUMENTS

| | | | |
|---|---|---|---|
| GB | 2 281 068 | A | 2/1995 |

* cited by examiner

*Primary Examiner*—Gary E Elkins
*Assistant Examiner*—Latrice Byrd
(74) *Attorney, Agent, or Firm*—Nixon & Vanderhye P.C.

(57) ABSTRACT

A reclosable carton having a tuck flap that slides between a first gable panel and side gussets is provided. The tuck flap is coupled to a second gable panel along a line that is in alignment with a non-continuous free edge. The tuck flap includes a tuck flap width that is less than widths of the first and second gable panels. The tuck flap also includes a tuck flap score that is spaced apart from the line. The side gussets forming the gable angle include two perforated score lines intersecting a top of the carton at the non-continuous free edge. The perforated scores are connected to a first intersecting score by two die cuts, which are angled substantially 45 degrees from the first intersecting score.

20 Claims, 7 Drawing Sheets

RECLOSABLE GABLE TOP CARTON

BACKGROUND

Gable top cartons are commonly used for packaging shelf-type products to be purchased by a customer. In general, a gable top carton includes two opposing gable panels coupled together by two opposing side gusset panels. Before the package is opened for the first time, the tops of both opposing gable panels meet with each other and are often adhered together by an adhesive to form a triangular shaped package top. The package is then opened by either breaking the adhesive or separating one of the gable panels into two portions such that one portion remains adhered to the other gable panel and the other portion is free.

Reclosing a gable top carton after it has been opened is highly desirable especially in instances where all of the contents of the carton are not fully dispensed at one time. In one example, a flap is coupled to one of the gable panels that includes a tab. A slit is included in the opposing gable panel. To reclose the gable top carton, the tab of the flap is engaged with the slit. In another example, a flap is coupled to one of the gable panels that includes an adhesive sticker. To reclose the gable top carton, the adhesive sticker is attached to the opposing gable panel.

Unfortunately, these types of reclosing features for gable top cartons often fail. In particular, the tabs of the flaps tend to break or tear away and the adhesive sticker eventually loses its adhesive properties. Not only does the failure of a reclosing feature of a gable top carton prevent a customer from safely storing contents of the package over a period of time, but also loose tabs and flaps can interfere with other packages that are being stored.

The discussion above is merely provided for general background information and is not intended to be used as an aid in determining the scope of the claimed subject matter.

SUMMARY

Embodiments of the invention form unique features of a sheet material that can be formed into a reclosable carton. The reclosable carton can be configured from an unopened position, to an opened position and to a reclosed or closed position. To reclose the carton, a unique tuck flap or extension panel is utilized that fully tucks between a first gable panel and side gussets. The tuck flap is defined by a free end and a fixed end. The fixed end is coupled to a second gable panel along a line that is in alignment with a non-continuous free edge of the sheet material. The tuck flap also includes a tuck flap width that extends between portions of the non-continuous free edge of the sheet material along the line. The tuck flap also includes a tuck flap score that is spaced apart from the line. The tuck flap width is less than a width of the second gable panel that the tuck flap is coupled to and a width of the first gable panel opposing the second gable panel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include sheet material formable into a reclosable carton. The reclosable carton can be configured from an unopened position, to an opened position and to a reclosed or closed position. To reclose the reclosable carton, a unique tuck flap or extension panel is utilized that fully tucks between a first gable panel and side gussets.

Figure 1:
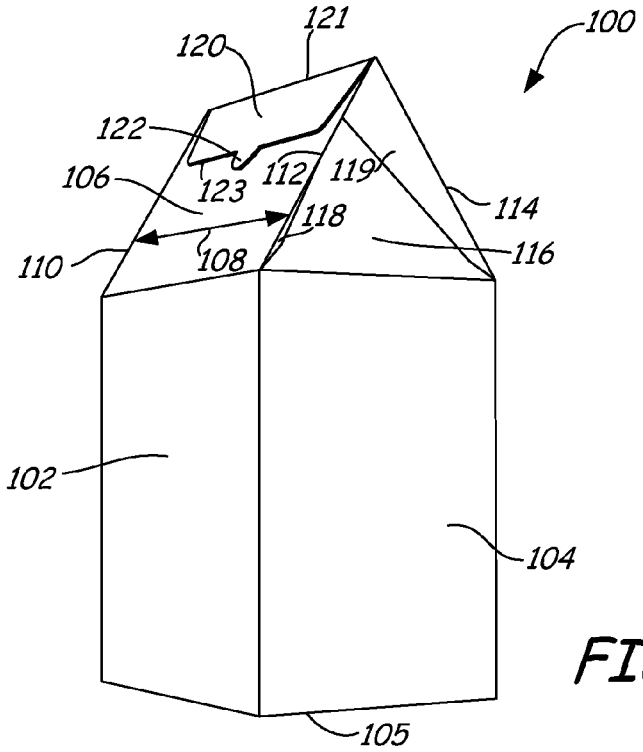
FIG. 1 is a perspective view of a reclosable carton in an unopened position under one embodiment.

FIG. 1 is a perspective view of a reclosable carton 100 in an unopened position under one embodiment. Reclosable carton 100 includes a back panel 102 and an opposing front panel (hidden from view), a first side panel 104 and an opposing second side panel (hidden from view) and a bottom 105. The first side panel 104 and the opposing second side panel couple the back panel 102 to the front panel. Reclosable carton 100 also includes a first gable panel 106 and an opposing second gable panel (hidden from view). The first gable panel 106 includes a first gable panel width 108 extending between a first score edge 110 and a second score edge 112. The second gable panel includes a second gable panel width (hidden from view) extending between a third score edge 114 and a fourth score edge (hidden from view). The first gable panel width 108 is substantially equivalent to the second gable panel width. A first gusset flap 116 is positioned between and adjacent to first and second gusset flap supports 118 and 119. The first gusset flap 116 and the first and second gusset flap supports 118 and 119 couple the first gable panel 106 to the second gable panel. A second gusset flap (hidden from view) opposes the first gusset flap 108 and is positioned between and adjacent to third and fourth gusset flap supports (hidden from view). The second gusset flap and the third and fourth gusset flap supports couple the second gable panel to first gable panel 106.

Reclosable carton 100 includes a tuck flap or extension panel 120 that is coupled to the second gable panel at a fixed end 121. When reclosable carton 100 is in an unopened position (as is the case in FIG. 1), tuck flap 120 extends from the second gable panel and adheres to the first gable panel 106 at or near a free end 123. In the embodiment illustrated in FIG. 1, tuck flap 120 includes a tab 122. Tab 122 is useful in allowing a person to release the adhesive between tuck flap 120 and first gable panel 106. A more detailed description of reclosable carton 100 will be discussed thoroughly in FIG. 3.

Figure 2:
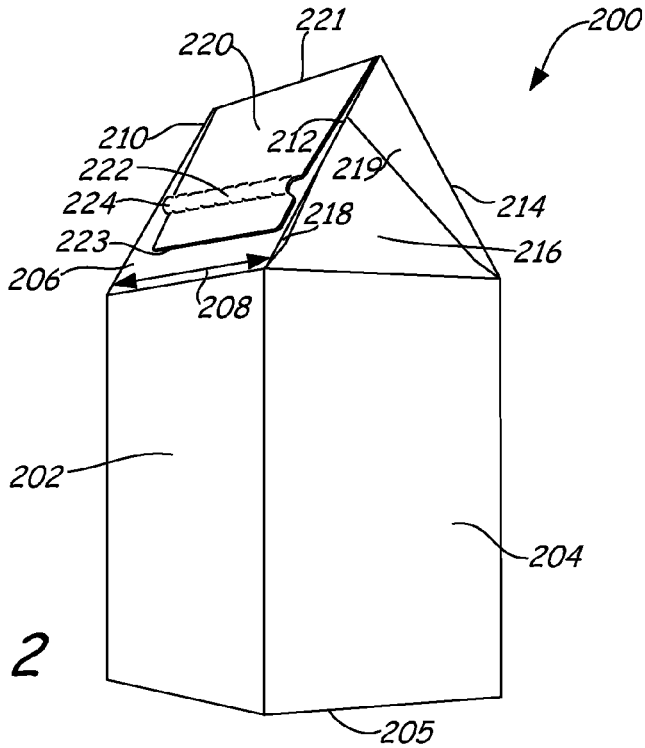
FIG. 2 is a perspective view of a reclosable carton in an unopened position under a second embodiment.

FIG. 2 is a perspective view of a reclosable carton 200 in an unopened position under one embodiment. Reclosable carton 200 includes a back panel 202 and an opposing front panel (hidden from view), a first side panel 204 and an opposing second side panel (hidden from view) and a bottom 205. The first side panel 204 and the opposing second side panel couple the back panel 202 to the front panel. Reclosable carton 200 also includes a first gable panel 206 and an opposing second gable panel (hidden from view). The first gable panel 206 includes a first gable panel width 208 extending between a first score edge 210 and a second score edge 212. The second gable panel includes a second gable panel width (hidden from view) extending between a third score edge 214 and a fourth score edge (hidden from view). The first gable panel width 208 is substantially equivalent to the second gable panel width. A first gusset flap 216 is positioned between and adjacent to first and second gusset flap supports 218 and 219. The first gusset flap 216 and the first and second gusset flap supports 218 couple the first gable panel 206 to the second gable panel. A second gusset flap (hidden from view) opposes the first gusset flap 208 and is positioned between and adjacent to third and fourth gusset flap supports (hidden from view). The second gusset flap and the third and fourth gusset flap supports couple the second gable panel to first gable panel 206.

Reclosable carton 200 includes a tuck flap or extension panel 220 that is coupled to the second gable panel at a fixed end 221. When reclosable carton 200 is in an unopened position (as is the case in FIG. 2), tuck flap 220 extends from the second gable panel and adheres to the first gable panel 206 at or near a free end 223. In the embodiment illustrated in FIG. 2, tuck flap 220 includes a zipper 222 that is defined between a first perforation line and a second perforation line that is parallel with the first perforation line. Zipper 222 is located between a part of tuck flap 220 that adheres to first gable panel 206 and fixed end 221. Zipper 222 can be removed from tuck flap 220 by grasping zipper end 224 and releasing the tuck flap 220 from first gable panel 206. A more detailed description of reclosable carton 200 will be discussed thoroughly in FIG. 4.

Figure 3:
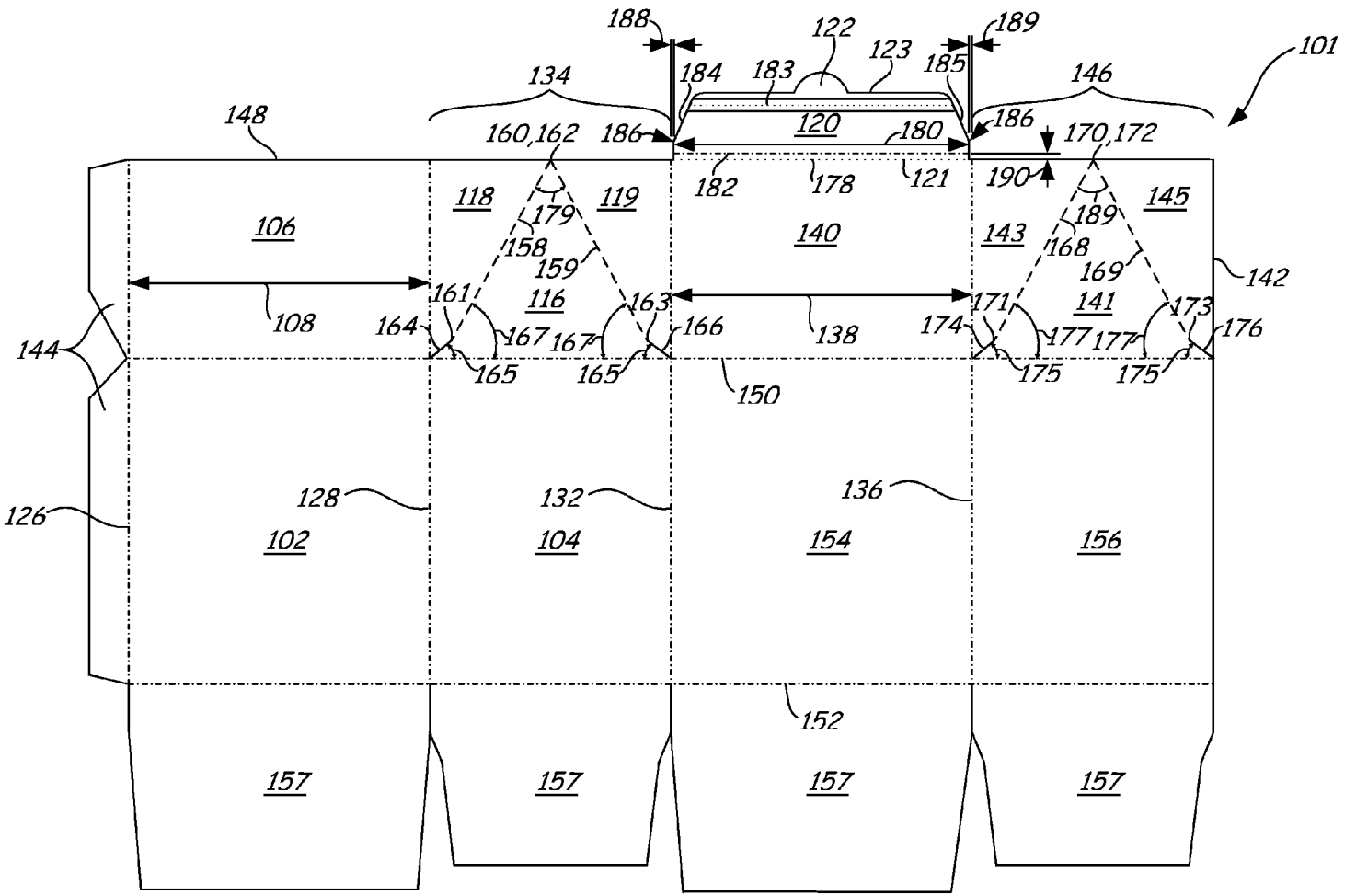
FIG. 3 is a plan view of a sheet material formable into the reclosable carton illustrated in FIG. 1.

FIG. 3 is a plan view of a sheet material 101 formable into reclosable carton 100 illustrated in FIG. 1. Sheet material 101 includes a first score 126 that defines first score edge 110 (FIG. 1) when sheet material 101 is folded at first score 126. A second score 128 defines second score edge 112 (FIG. 1) when sheet material 101 is folded at second score 128. Second score 128 is substantially parallel with first score 126 and spaced apart from the first score by first gable panel width 108 (also illustrated in FIG. 1). First score 126 and second score 128 define first gable panel 106. A third score 132 defines third score edge 114 (FIG. 1) when sheet material 101 is folded at third score 132. Third score 132 is spaced apart from and is substantially parallel with second score 128 to define a first side gusset panel 134. First side gusset panel 134 includes first gusset flap 116 positioned between first gusset flap support 118 and second gusset flap support 119 (as also illustrated in FIG. 1). A fourth score 136 defines the fourth score edge (hidden from view in FIG. 1) when sheet material 101 is folded at fourth score 136. Fourth score 136 is substantially parallel with third score 132 and is spaced apart from the third score by a second gable panel width 138. As discussed above, first gable panel width 108 is substantially equivalent to second gable panel width 138. Fourth score 136 and third score 132 define a second gable panel 140. A continuous free edge 142 forms at least first score edge 110 (FIG. 1) with first score 126. In particular, glue flaps 144 receive an adhesive such that continuous free edge 142 can be positioned and held in place adjacent first score 126 by adhering glue flaps 144 to second side gusset panel 146 and second side panel 156. Continuous free edge 142 is spaced apart from and substantially parallel with fourth score 136 to define second side gusset panel 146. Second side gusset panel 146 includes a second gusset flap 141 positioned between a third gusset flap support 143 and a fourth gusset flap support 145.

Sheet material 101 includes a non-continuous free edge or non-continuous top free edge 148 that is substantially perpendicular to and intersects with first score 126, second score 128, third score 132, fourth score 136 and continuous free edge 142. Non-continuous free edge 148 defines edges of first gable panel 106, first side gusset panel 134, second gable panel 140 and second side gusset panel 146. Sheet material 101 also includes a first intersecting score 150 and a second intersecting score 152. First intersecting score 150 is spaced apart from and parallel with non-continuous free edge 148. Second intersecting score 152 is spaced apart from first intersecting score 150 and also parallel with non-continuous free edge 148. As such, first intersecting score 150 is positioned between non-continuous free edge 148 and second intersecting score 152. First intersecting score 150 defines edges of first gable panel 106, first side gusset panel 134, second gable panel 140 and second side gusset panel 146. Defined between first intersecting score 150 and second intersecting score 152 are a set of panels that includes back panel 102 (also illustrated in FIG. 1), first side panel 104 (also illustrated in FIG. 1), a front panel 154 (hidden from view in FIG. 1) and a second side panel 156 (hidden from view in FIG. 1). Second intersecting score 152 also defines bottom panels 157 that form bottom 105 (FIG. 1). As illustrated in FIG. 3, bottom panels 157 are for use in forming a sealed end bottom. However, it should be understood that other types of bottom panels can be utilized instead of panels 157 to form other types of bottoms. For example, other types of bottom panels can be provided that form a tuck bottom, an auto bottom and a snap lock bottom.

First side gusset panel 134 includes a first and second perforated score lines 158 and 159. It should be understood that both first and second perforated score lines 158 and 159 include both a score as well as spaced apart perforations. For example, first and second perforated score lines 158 and 159 can include an ⅛ inch perforation spaced ⅛ inch apart from each other along a score. However, any perforation dimension and spaced dimension can be utilized.

Perforated score line 158 includes a first end 160 and a second end 161. Perforated score line 159 includes a first end 162 and a second end 163. At first end 160 and first end 162, perforated score lines 158 and 159 intersect with each other at non-continuous free edge 148 to form first gusset flap 116 between first and second gusset flap supports 118 and 119. First side gusset panel 134 also includes a first die cut line 164 and a second die cut line 166. First die cut line 164 extends from an intersection of second score 128 and first intersecting score 150 to second end 161 of first perforated score line 158. Second die cut line 166 extends from an intersection of third score 132 and first intersecting score 150 to second end 163 of second perforated score line 159. First die cut line 164 and second die cut line 166 are oriented at an angle 165 substantially 45 degrees from first intersecting score 150. The 45 degree angles 165 facilitate easy gable top folding and prevent undesirable bulging of the second score edge 112 (FIG. 1) and third score edge 114 (FIG. 1) when sheet material 101 is formed into carton 100 (FIG. 1). In addition, the first and second perforated score lines 158 and 159 are oriented at an angle 167 relative to first intersecting score 150 that is different than the substantially 45 degree angle 165 that the first die cut 164 and the second die cut 166 are oriented from first intersecting score 150.

A length of first die cut line 164 is substantially similar to a length of second die cut line 166. The lengths of first die cut line 164 and second die cut line 166 depend on an angle 179 at non-continuous free edge 148 between perforated score lines 158 and 159. The angle 179 between perforated score lines 158 and 159 is a gable top angle, which is a function of a height and width of first side gusset panel 134. In one example embodiment, lengths of first and second die cut lines 164 and 166 are ⅜ inch if the angle at non-continuous free edge 148 between first and second perforated score lines 158 and 159 is 53 degrees.

Second side gusset panel 146 includes a third and fourth perforated score lines 168 and 169. It should be understood that both third and fourth perforated score lines 168 and 169 include both a score as well as spaced apart perforations. For example, third and fourth perforated score lines 168 and 169 can include an ⅛ inch perforation spaced ⅛ inch apart from each other. However, any perforation dimension and spaced dimension can be utilized.

Perforated score line 168 includes a first end 170 and a second end 171. Perforated score line 169 includes a first end 172 and a second end 173. At first end 170 and first end 172, perforated score lines 168 and 169 intersect with each other at non-continuous free edge 148 to form second gusset flap 141 between first and second gusset flap supports 143 and 145. Second side gusset panel 146 also includes a third die cut line 174 and a fourth die cut line 176. Third die cut line 174 extends from an intersection of fourth score 136 and first intersecting score 150 to second end 171 of third perforated score line 168. Fourth die cut line 176 extends from an intersection of continuous free edge 142 and first intersecting score 150 to second end 173 of fourth perforated score line 169. Third die cut line 174 and fourth die cut line 176 are oriented at an angle 175 substantially 45 degrees from first intersecting score 150. The 45 degree angles 175 facilitate easy gable top folding and prevent undesirable bulging of the third score edge (hidden from view in FIG. 1) and first score edge 112 (FIG. 1) when sheet material 101 is formed into carton 100 (FIG. 1). In addition, the third and fourth perforated score lines 168 and 169 are oriented at an angle 177 relative to first intersecting score 150 that is different than the substantially 45 degree angle 175 that the third die cut 174 and the fourth die cut 176 are oriented from the first intersecting score 150.

As previously discussed with reference to the die cuts of first side gusset panel 134, a length of third die cut line 174 is substantially similar to a length of second die cut line 176. The lengths of third die cut line 174 and fourth die cut line 176 depend on an angle at non-continuous free edge 148 between perforated score lines 168 and 169. The angle 189 between perforated score lines 168 and 169 is a gable top angle, which depends on a height and width of second side gusset panel 146. In one example embodiment, lengths of first and second die cut lines 176 and 178 are ⅜ inch if the angle at non-continuous free edge 148 between first and second perforated score lines 168 and 169 is 53 degrees.

Sheet material 101 also includes extension panel or tuck flap 120 (also illustrated in FIG. 1) having fixed end 121 (also illustrated in FIG. 1) that is coupled to second gable panel 140 along a line 178 that is in alignment with non-continuous free edge 148. Extension panel 120 also includes free end 123 (also illustrated in FIG. 1). Extension panel 120 has an extension panel width or tuck flap width 180 that extends between portions of non-continuous free edge 148 and along line 178. Extension panel width 180 is less than first gable panel width 108 and second gable panel width 138. An extension panel score or tuck flap score 182 is located above and spaced apart from line 178. An extension panel adhesive area or tuck flap adhesive area 183 is also located above and spaced apart from line 178 as well as spaced apart and above extension panel score 182. Extension panel adhesive area 183 receives an adhesive such that extension panel 120 can be adhered to first gable panel 106 when sheet material 101 is formed into unopened carton 100 as illustrated in FIG. 1. As discussed in FIG. 1, free end 123 of extension panel 120 includes a tab 122 that is useful in allowing a person to separate the adhesive bound between tuck flap 120 and first gable panel 106.

Extension panel 120 further includes first and second side edges 184 and 185 located between fixed end 121 and free end 123. In the embodiment illustrated in FIG. 3, at least portion of each of the first and second side edges 184 and 185 taper from a first select point 186 located between extension panel score 182 and free end 123 towards the free end. In the embodiment illustrated in FIG. 3, the taper of first and second side edges 184 and 185 begins at first select point 186 and terminates at free end 123 such that the extension panel width is at a decreased dimension at free end 123 compared with extension panel width 180.

As illustrated in FIG. 3, extension panel 120 couples to second gable panel 140 such that there is a distance 188 between third score 132 and first side edge 184 and a distance 189 between fourth score 136 and second side edge 185. Under some embodiments, distances 188 and 189 are equal to the thickness of sheet material 101. Under one specific embodiment, distance 188 is approximately 1/32 of an inch and distance 189 is approximately 1/32 of an inch. As also illustrated in FIG. 3, extension panel score 182 is positioned above and spaced apart from line 178 (in alignment with non-continuous free edge 148) a distance 190. Under some embodiments, distance 190 is equal to three times the thickness of sheet material 101. Under one particular embodiment, distance 190 is approximately 3/32 of an inch.

Figure 4:
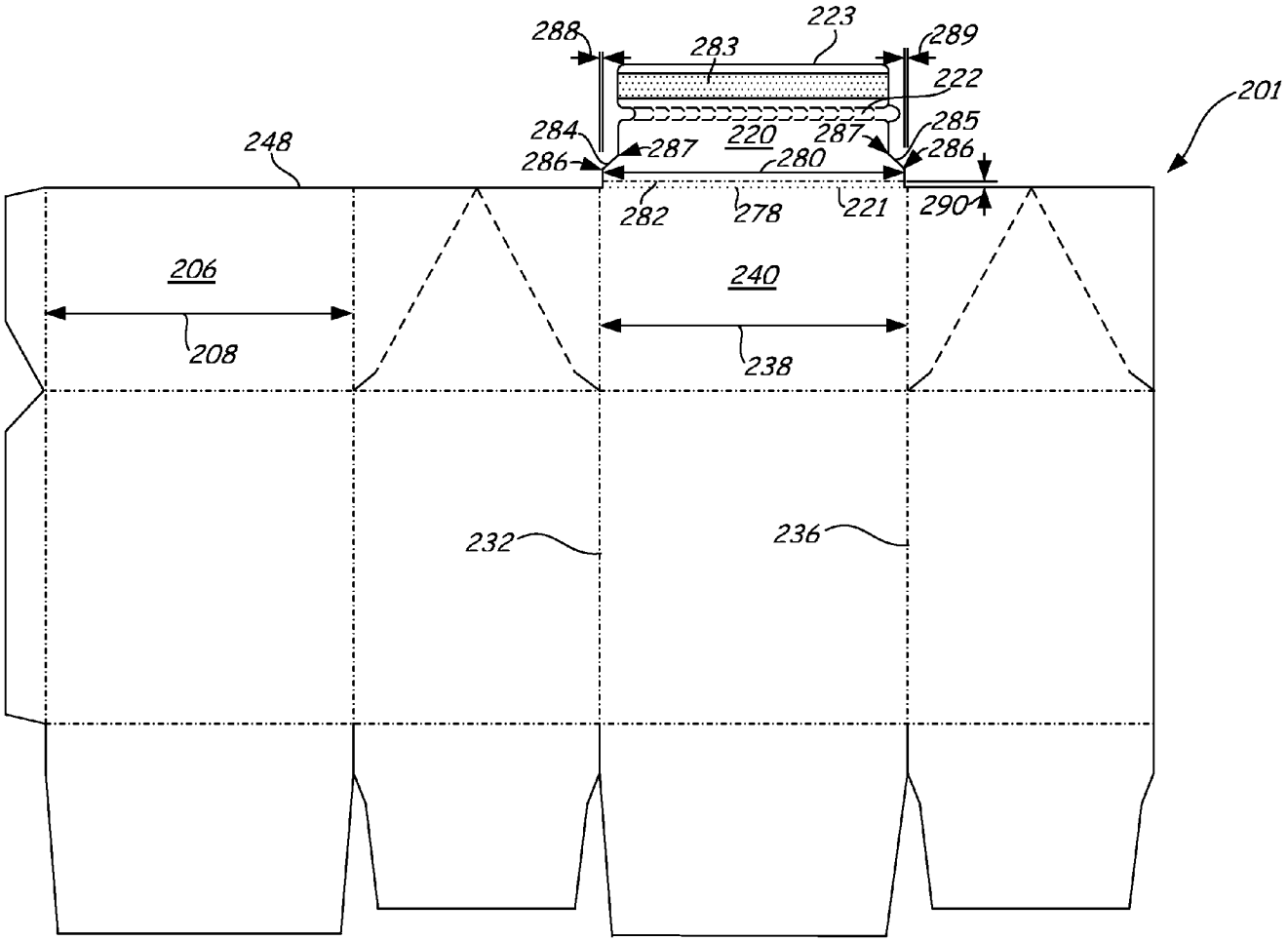
FIG. 4 is a plan view of a sheet material formable into the reclosable carton illustrated in FIG. 2.

FIG. 4 is a plan view of a sheet material 201 formable into reclosable carton 200 illustrated in FIG. 2. Sheet material 201 is similar to sheet material 101 of FIG. 1. However, as clearly illustrated in FIGS. 2 and 4, sheet material 201 includes an extension panel or tuck flap 220 that is different. Extension panel 220 includes fixed end 221 (also illustrated in FIG. 2) that is coupled to a second gable panel 240 (as similarly discussed in FIG. 3) along a line 278 that is in alignment with a non-continuous free edge 248 (as similarly discussed in FIG. 3). Extension panel 220 also includes free end 223 (also illustrated in FIG. 2). Extension panel 220 has an extension panel width or tuck flap width 280 that extends between portions of non-continuous free edge 248 and along line 278. Extension panel width 280 is less than first gable panel width 208 (illustrated in FIG. 2) and second gable panel width 238 (hidden from view in FIG. 2). An extension panel score or tuck flap score 282 is located above and spaced apart from line 278.

Extension panel 220 includes zipper 222 (as also illustrated in FIG. 2) that is located above and spaced apart from extension panel score 282. An extension panel adhesive area or tuck flap adhesive area 283 is located above and spaced apart from zipper 222. Extension panel adhesive area 283 receives an adhesive such that extension panel 220 can be adhered to first gable panel 206 when sheet material 201 is formed into unopened carton 200 as illustrated in FIG. 2. Instead of loosening the adhesive to open carton 200 as would be done when opening carton 100 of FIG. 1, zipper 222 is "unzipped" by pulling on zipper 222 to tear zipper 222 away from the remainder of extension panel 222 along the parallel perforations that define zipper 222 such that the adhesive remains intact and the extension panel 220 from fixed end 221 to zipper 222 is freed.

Extension panel 220 further includes first and second side edges 284 and 285 located between fixed end 221 and free end 223. In the embodiment illustrated in FIG. 4, at least a portion of each of the first and second side edges 284 and 285 taper from first select points 286 located between extension panel score 282 and free end 223 towards the free end. In the embodiment illustrated in FIG. 4, the taper of first and second side edges 284 and 285 begins at first select points 286 and terminates at a second select point 287 such that the extension panel width is at a decreased dimension at second select points 287 compared with extension panel width 280.

As illustrated in FIG. 4, extension panel 220 couples to second gable panel 240 such that there is a distance 288 between a third score 232 (as similarly discussed in FIG. 3) and first side edge 284 and a distance 289 between fourth score 236 (as similarly discussed in FIG. 3) and second side edge 285. Under one embodiment, distances 288 and 289 are equal to the thickness of sheet material 201 and under one example embodiment are approximately 1/32 of an inch. As also illustrated in FIG. 4, extension panel score 282 is positioned above and spaced apart from line 278, which is in alignment with non-continuous free edge 248, a distance 290. Under one embodiment, distance 290 is equal to three times the thickness of sheet material 201. Under one particular embodiment, distance 290 is approximately 3/32 of an inch.

Figure 5:
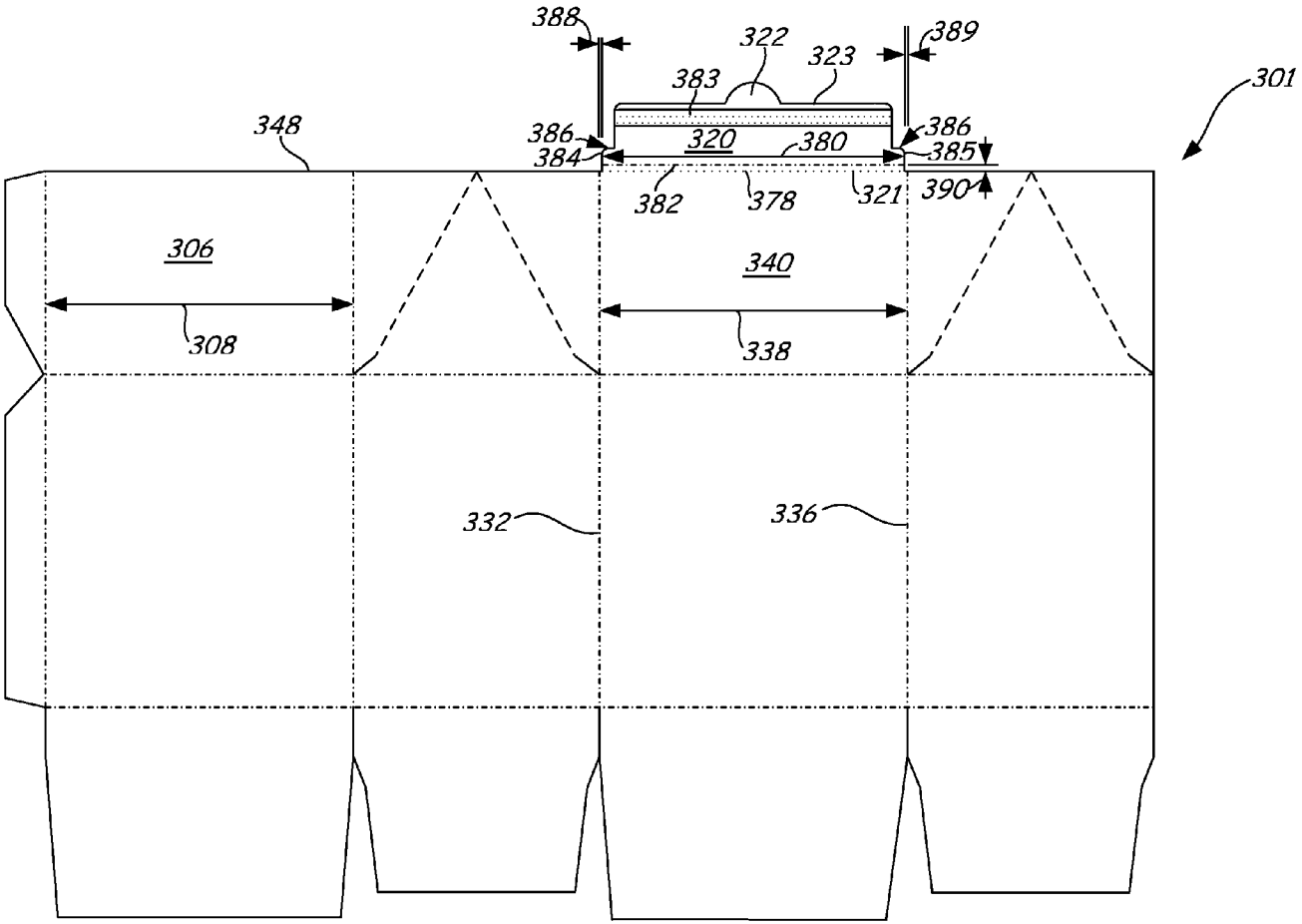
FIG. 5 is a plan view of sheet material formable into a reclosable carton under a further embodiment.

FIG. 5 is a plan view of a sheet material 301 formable into a reclosable carton. Sheet material 301 is similar to sheet material 101 of FIG. 1 and sheet material 201 of FIG. 2. However, as clearly illustrated in FIG. 5, sheet material 301 includes an extension panel or tuck flap 320 that is different. Extension panel 320 includes a fixed end 321 that is coupled to a second gable panel 340 (as similarly discussed in FIG. 3) along a line 378 that is in alignment with a non-continuous free edge 348 (as similarly discussed in FIG. 3). Extension panel 320 also includes a free end 323. Extension panel 320 has an extension panel width or tuck flap width 380 that extends between portions of non-continuous free edge 348 and along line 378. Extension panel width 380 is less than a first gable panel width 308 (as similarly discussed in FIG. 3) and second gable panel width 338 (as similarly discussed in FIG. 3). An extension panel score or tuck flap score 382 is located above and spaced apart from line 378.

An extension panel adhesive area or tuck flap adhesive area 383 is also located above and spaced apart from line 378 as well as spaced apart and above extension panel score 382. Extension panel adhesive area 383 receives an adhesive such that extension panel 320 can be adhered to a first gable panel 306 (as similarly discussed in FIG. 3) when sheet material 301 is formed into an unopened carton. Free end 323 of extension panel 320 includes a tab 322 that is useful in allowing a person to release adhesive between tuck flap 320 and first gable panel 306.

Extension panel 320 further includes first and second side edges 384 and 385 located between fixed end 321 and free end 323. Unlike the embodiments illustrated in FIGS. 3 and 4, first and second side edges 384 and 385 do not taper. Instead, at a first select point 386, the extension panel width is at a decreased dimension compared with extension panel width 380.

As illustrated in FIG. 5, extension panel 320 couples to second gable panel 340 such that there is a distance 388 between a third score 332 (as discussed in FIG. 3) and first side edge 384 and a distance 389 between fourth score 336 (as discussed in FIG. 3) and second side edge 385. Under some embodiments, distances 388 and 389 are equal to the thickness of sheet material 301. Under one particular embodiment, distances 388 and 389 are approximately 1/32 of an inch, for example. As also illustrated in FIG. 5, extension panel score 382 is positioned above and spaced apart from line 378, which is in alignment with non-continuous free edge 348, by a distance 390. Under one embodiment, distance 390 is equal to three times the thickness of sheet material 301. Under one particular embodiment, distance 390 is approximately 3/32 of an inch.

Figure 6:
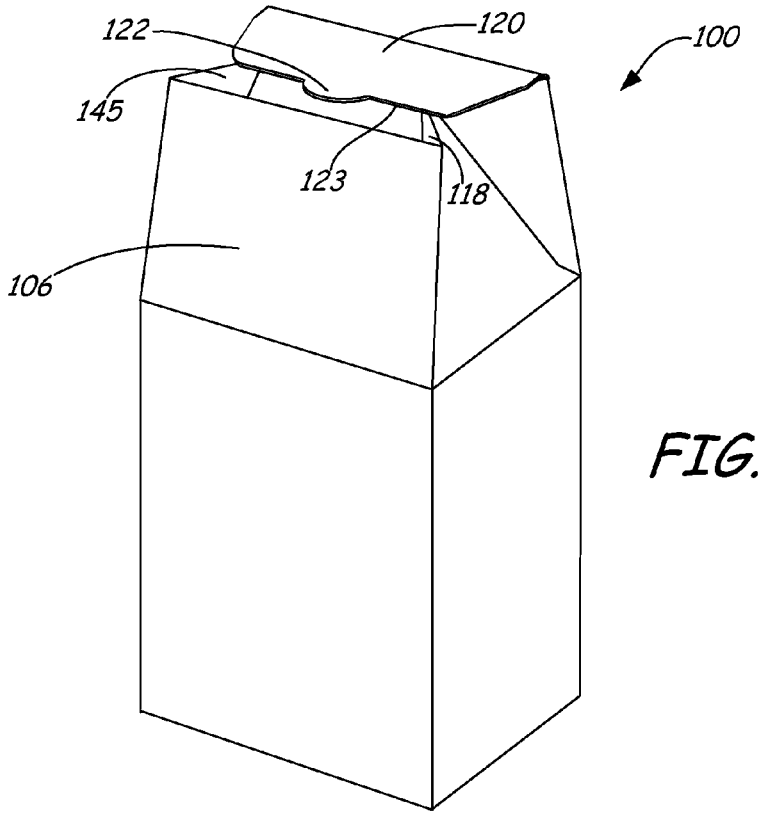
FIG. 6 is a perspective view of the reclosable carton illustrated in FIG. 1 in an open position under one embodiment.
Figure 7:
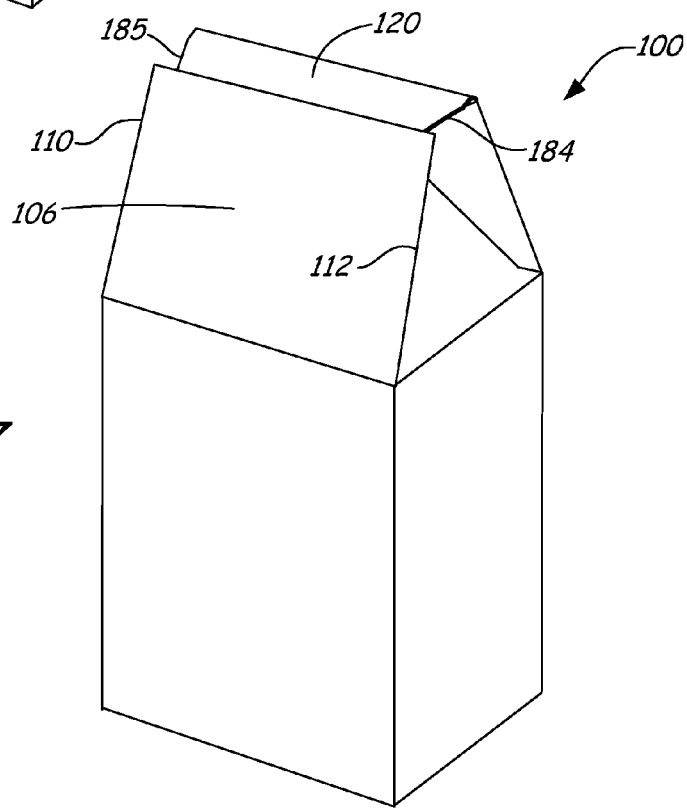
FIG. 7 is a perspective view of the reclosable carton illustrated in FIG. 6 in a partially closed position.

FIG. 6 illustrates a perspective view of reclosable carton 100 illustrated in FIG. 1 in an opened position under one embodiment. In FIG. 6, the bond that adheres tuck flap or extension panel 120 to first gable panel 106 has been broken using tab 122 such that reclosable carton 100 is in an open position. FIG. 7 illustrates a perspective view of reclosable carton 100 of FIG. 6 as the reclosable carton is being reclosed or put into a closed position. As illustrated in FIG. 7, free end 123 (FIG. 6) of tuck flap or extension panel 120 is slid between front gable panel 106 and first gusset support flap 118 (FIGS. 1, 3 and 6) and fourth gusset support flap 145 (FIGS. 3 and 6) along second score edge 112 and along first score edge 110. Tuck flap or extension panel 120 of reclosable carton 100 is fully slid between first gable panel 106 and first gusset support flap 118 and fourth gusset support flap 145 to form a reclosed or closed position as illustrated perspectively in FIG. 8 and as illustrated from a side view in FIG. 9.

Figure 8:
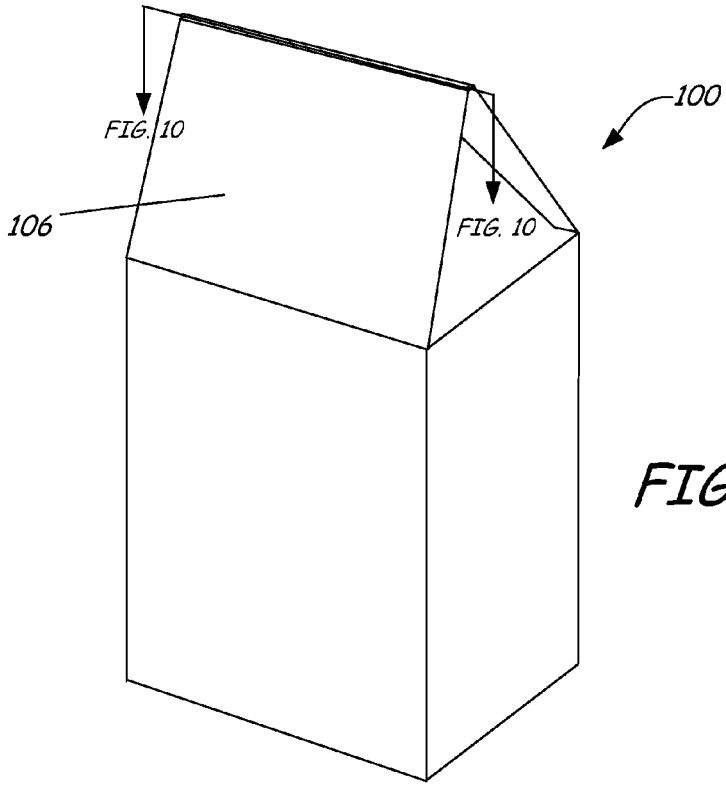
FIG. 8 is a perspective view of the reclosable carton illustrated in FIGS. 6 and 7 in a closed position under one embodiment.
Figure 9:
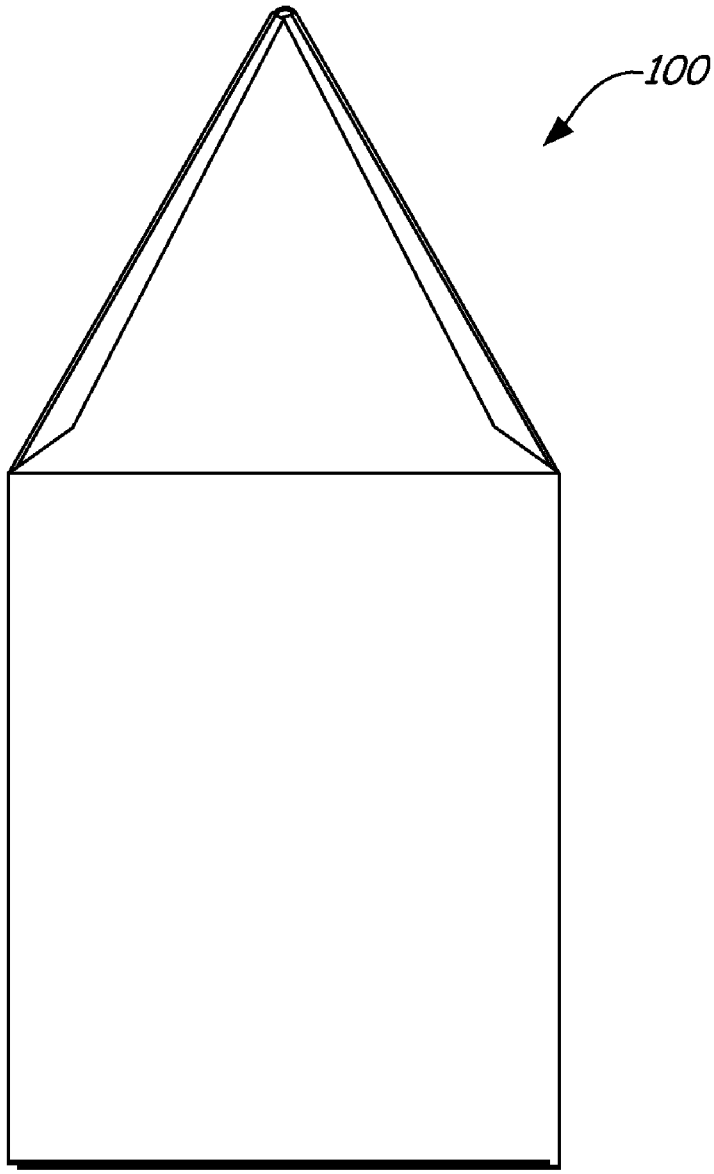
FIG. 9 is side view of the reclosable carton illustrated in FIG. 8.

Distances 188, 189 and 190 (FIG. 3) allow reclosable carton 100 to be placed into a reclosed or closed position. In particular, distances 188 and 189 allow tuck flap 120 to fit between score 110 and score 112 in the interior of carton 100 by providing space for the thickness of sheet material 101 at scores 110 and 112. In addition, distances 188 and 189 are such that side edges 184 and 185 are in frictional contact with the interior surfaces of scores 110 and 112 to help keep tuck flap 120 in the closed position. Distance 190 places score 182 above edge 148 so that tuck flap 120 can be inserted in between flap 106 and gusset support flaps 118 and 145. Therefore, in the closed position, as shown in FIG. 8, the bend in tuck flap 120 is located at score 182. If score 182 were located in line with edge 148, an additional bend outside of score 182 would be needed in tuck flap 120 to allow tuck flap 120 to be inserted behind flap 106. In addition, tapered side edges 184 and 185 are also helpful in allowing reclosable carton 100 to be placed into a reclosed or closed position. As it can be seen in FIGS. 8 and 9, reclosable carton in a reclosed position secures contents in the carton as well as when contents in the carton were secured in an unopened position.

Figure 10:
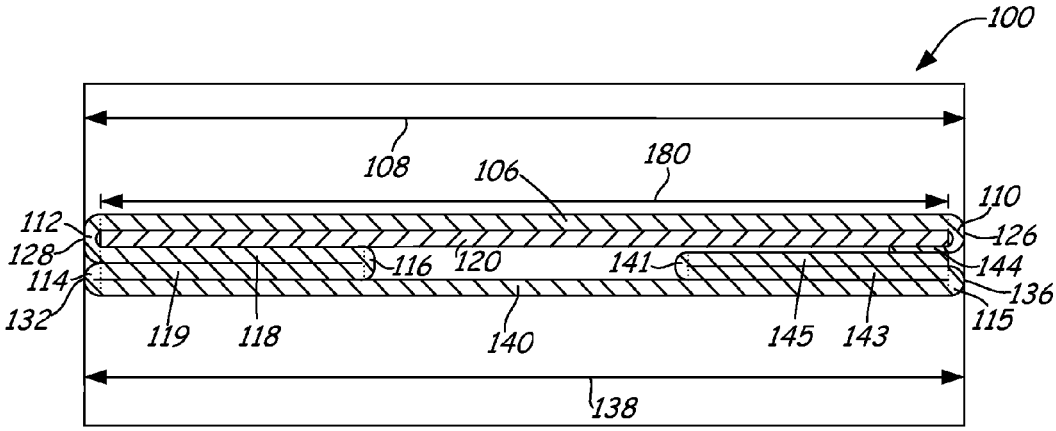
FIG. 10 is a sectional view of the reclosable carton taken along section lines illustrated in FIG. 8.

FIG. 10 is a sectional view of reclosable carton 100 taken along section lines illustrated in FIG. 8. Reclosable carton 100 includes first gable panel 106 and opposing second gable panel 140. First gable panel 106 includes first gable panel width 108 extending between first score 126 that defines first score edge 110 and second score 128 that defines second score edge 112. Second gable panel 140 includes a second gable panel width 138 extending between third score 132 that defines third score edge 114 and fourth score 136 that defines fourth score edge 115. First gusset flap 116 is positioned between and adjacent to first and second gusset flap supports 118 and 119. First gusset flap 116 and first and second gusset flap supports 118 and 119 couple first gable panel 106 to second gable panel 140. Second gusset flap 141 opposes first gusset flap 116 and is positioned between and adjacent to third and fourth gusset flap supports 143 and 145. Second gusset flap 141 and third and fourth gusset flap supports 143 and 145 couple second gable panel 140 to first gable panel 106. Adhesive flap 144 is adhesively attached to fourth gusset flap 145.

As illustrated in FIG. 10, tuck flap or extension panel 120 rests between first gable panel 106 and first and fourth gusset flap supports 118 and 145. As also illustrated in FIG. 10, the tapered width of tuck flap or extension panel 120 as well as distances 188 and 189 (FIG. 3) allow tuck flap or extension panel 120 to extend between the interior of first score edge 110 and second score edge 112.

The unique features of sheet material illustrated in FIGS. 3, 4 and 5 allow the formation of reclosable cartons that can be configured from an unopened position, to an opened position and to a reclosed or closed position. The reclosed position includes the tucking of a tuck flap into the reclosable carton. These unique features can be utilized in a variety of panel dimensions such that variety of different sized cartons can be formed for a variety of different purposes. In addition, the unique feature of die cut lines formed in side gusset panels at a 45 degree angle from the first intersecting score facilitate easy gable top folding and prevent undesirable bulging of the first, second, third and fourth score edges of a carton.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sheet material formable into a carton comprising:

a first score;

a second score substantially parallel with the first score and spaced apart by a first gable panel width, wherein the second score and the first score define a first gable panel;

a third score spaced apart from and substantially parallel with the second score, wherein the third score and the second score define a side gusset panel;

a fourth score substantially parallel with the third score and spaced apart by a second gable panel width that is substantially equivalent to the first gable panel width, wherein the fourth score and the third score define a second gable panel;

a non-continuous free edge that is substantially perpendicular to and intersecting with the first, second, third and fourth scores to at least define edges of the first gable panel, the side gusset panel and the second gable panel; and an extension panel having a fixed end coupled to the second gable panel along a line that is in alignment with the non-continuous free edge and having a free end, wherein the extension panel includes an extension panel width extending between portions of the non-continuous free edge along the line and an extension panel score that is spaced from the line, the extension panel width being less than the first gable panel width and less than the second gable panel width across an entirety of the extension panel from the fixed end of the extension panel to the free end of the extension panel.

2. The sheet material of claim 1, wherein the first gable panel, the side gusset panel and the second gable panel are also defined by an intersecting score that intersects with the first, second, third and fourth scores and is spaced apart from the non-continuous free edge.

3. The sheet material of claim 2, wherein the side gusset panel comprises first and second perforated score lines, wherein first ends of the first and second perforated score lines intersect with the non-continuous free edge to form a gusset flap located between a pair of gusset flap supports.

4. The sheet material of claim 3, wherein the side gusset panel further comprises:

a first die cut line extending from an intersection of the second score and the intersecting score to a second end of the first perforated score line; and a second die cut line extending from the intersection of the third score and the continuous bottom score to a second end of the second perforated score line.

5. The sheet material of claim 4, wherein the first die cut line and the second die cut line are oriented substantially 45 degrees from the intersecting score.

6. The sheet material of claim 1, wherein the extension panel further comprises first and second side edges located between the fixed end and the free end, wherein a portion of each of the first and second side edges taper from a first select point located between the extension panel score and the free end towards the free end.

7. The sheet material of claim 5, wherein the taper of the first and second side edges begins at the first select point and terminates at the free end.

8. The sheet material of claim 5, wherein the taper of the first and second side edges begins at the first select point and terminates at a second select point along the first and second side edges of the extension panel that is spaced apart from the free end.

9. The sheet material claim of claim 5, wherein a distance between the third score and the first side edge of the extension panel is approximately equal to the thickness of the sheet material and a distance between the fourth score and the second side edge of the extension panel is approximately equal to the thickness of the sheet material.

10. The sheet material of claim 1, wherein a distance between the extension panel score and the line in alignment with the non-continuous free edge is approximately three times the thickness of the sheet material.

11. A reclosable carton comprising:

a first gable panel having a first gable panel width extending between a first score edge and a second score edge;

a second gable panel opposing the first gable panel and having a second gable panel width extending between a third score edge and a fourth score edge, wherein the second gable panel width is substantially equivalent to the first gable panel width;

a first side gusset panel that couples the second score edge of the first gable panel to the third score edge of the second gable panel;

a second side gusset panel opposing the first side gusset panel that couples the first score edge of the first gable panel to the fourth score edge of the second gable panel;

a non-continuous top edge that is substantially perpendicular to and intersects with the first, second, third and fourth score edges to define the first gable panel, the second gable panel, the first side gusset panel and the second side gusset panel; and a tuck flap having a fixed end coupled to the second gable panel at a line that is in alignment with the non-continuous top edge and having a free end, wherein the tuck flap includes a tuck flap width extending between portions of the non-continuous top edge along the line and a tuck flap score that is spaced from the line, the tuck flap width being less than the first gable panel width and less than the second gable panel width across an entirety of the tuck flap from the fixed end of the tuck flap to the free end of the tuck flap.

12. The reclosable carton of claim 11, wherein the first and second gable panels and the first and second side gusset panels are also defined by a first intersecting score that intersects with the first, second, third and fourth scored edges.

13. The reclosable carton of claim 12, wherein each of the side gusset panels comprises:

a pair of perforated score lines that intersect at the non-continuous top edge, wherein first and second perforated score lines included in the first side gusset panel form a first gusset flap located between a pair of gusset flap supports and third and fourth perforated score lines included in the second gusset panel form a second gusset flap located between a pair of gusset flap supports.

14. The reclosable carton of claim 13, wherein the first side gusset panel further comprises a first die cut extending from an intersection of the second score edge and the first intersecting score to the first perforated score line and a second die cut extending from an intersection of the third score edge and the first intersecting score to the second perforated score line; and wherein the second gusset panel further comprises a third die cut extending from an intersection of the fourth score edge and the first intersecting score to the third perforated score line and a fourth die cut extending from an intersection of the first intersecting score and a continuous free edge that is aligned with the first score edge to the fourth perforated score line.

15. The reclosable carton of claim 14, wherein each of the die cuts of the first and second side gusset panels is oriented substantially 45 degrees from the first intersecting score.

16. The reclosable carton of claim 11, wherein the tuck flap further comprises first and second side edges located between the fixed end and the free end, wherein a portion of each of the first and second side edges taper from a first select point located between the tuck flap score and the free end towards the free end.

17. The reclosable carton of claim 16, wherein the tapers of the first and second side edges begin at the first select point and terminate at the free end.

18. The reclosable carton of claim 16, wherein the tapers of the first and second side edges begin at the first select point and terminates at a second select point that is spaced apart from the free end along the first and second side edges of the tuck flap.

19. A sheet material formable into a carton comprising:

a first score;

a second score substantially parallel with the first score and spaced apart to define a first gable panel;

a third score substantially parallel with the second score and spaced apart to define a side gusset panel;

a fourth score substantially parallel with the third score and spaced apart to define a second gable panel;

a non-continuous free edge substantially perpendicular to and intersecting with the first, second, third and fourth scores to at least define edges of the first gable panel, the side gusset panel and the second gable panel;

a first intersecting score substantially parallel with the non-continuous free edge and intersecting with the first, second, third and fourth scores to at least define the first gable panel, the side gusset panel and the second gable panel;

wherein the side gusset panel comprises:

first and second perforated score lines, wherein first ends of the first and second perforated score lines intersect at the non-continuous free edge to form a gusset flap located between a pair of gusset flap supports;

a first die cut extending from the intersection of the second score and the first intersecting score to a second end of the first perforated score line;

a second die cut extending from the intersection of the third score and the first intersecting score to a second end of the second perforated score line; and wherein the first die cut and the second die cut are oriented substantially 45 degrees from the first intersecting score; and an extension panel having a fixed end coupled to the second gable panel along a line that is in alignment with the non-continuous free edge and having a free end, wherein the extension panel includes an extension panel width extending between portions of the non-continuous free edge along the line and an extension panel score that is spaced from the line, the extension panel width being less than a first gable panel width of the first gable panel and a second gable panel width of the second gable panel across an entirety of the extension panel from the fixed end of the extension panel to the free end of the extension panel.

20. The sheet material of claim 19, wherein the first and second perforated score lines are oriented at an angle relative to first intersecting score that is different than the substantially 45 degrees that the first die cut and the second die cut are oriented from the first intersecting score.

* * * * *